United States Patent [19]

Wang

[11] 4,333,184

[45] Jun. 8, 1982

[54] MULTI-FUNCTION CLOSET STOOL

[76] Inventor: Hsian Wang, No. 11, Alley 38, La. 80 Wen Lin N. Rd. Peitou, Taipei, Taiwan

[21] Appl. No.: 132,532

[22] Filed: Mar. 21, 1980

[51] Int. Cl.[3] ..... E03D 1/00; E03D 5/012; E03D 5/04; E03D 1/34

[52] U.S. Cl. ..... 4/313; 4/250; 4/314; 4/388; 4/407; 4/408; 4/411; 4/DIG. 3

[58] Field of Search ..... 4/300, 302, 313, 324–328, 4/340–342, 353–356, 359–361, 363, 364, 378, 388, 392, 393, 395, 396, 405, 407, 408, 411, 413, 415, DIG. 3, 249, 250, 248, 314, 251

[56] References Cited

U.S. PATENT DOCUMENTS

| | | | |
|---|---|---|---|
| Re. 12,951 | 5/1909 | Barrett | 4/360 X |
| 399,690 | 3/1889 | Newell | 4/388 |
| 496,572 | 5/1893 | Lewis | 4/388 |
| 547,503 | 10/1895 | Scott | 4/407 X |
| 618,609 | 1/1899 | McHugh | 4/388 X |
| 702,060 | 6/1902 | Haynes | 4/354 |
| 926,155 | 6/1929 | Walls, Jr. | 4/356 |
| 1,069,658 | 8/1913 | Drew | 4/388 X |
| 1,605,939 | 11/1926 | Haas | 4/408 |
| 1,977,401 | 4/1935 | Barce | 4/364 X |
| 2,835,765 | 6/1958 | Hosking | 4/407 |
| 3,056,143 | 10/1962 | Foster | 4/313 X |
| 3,397,408 | 8/1968 | Skousgaard | 4/359 |
| 3,605,125 | 9/1971 | Gibbs et al. | 4/361 |
| 3,628,195 | 12/1971 | Skousgaard | 4/354 |
| 3,780,384 | 12/1973 | Rivelle | 4/408 X |
| 4,149,283 | 4/1979 | Knudtson | 4/325 X |
| 4,183,108 | 1/1980 | Hamilton | 4/354 |

FOREIGN PATENT DOCUMENTS

| | | | |
|---|---|---|---|
| 570822 | 12/1957 | Italy | 4/408 |

*Primary Examiner*—Stuart S. Levy
*Attorney, Agent, or Firm*—Holman & Stern

[57] ABSTRACT

This invention, is a multi-function closet stool, which can really serve the purpose of automatic timing, measuring pressure, flushing and saving water. When one sits on the seat of closet stool, the driving piece pulls the driving steel cable to make timing and piston assembly simultaneously actuate and control arm sandwich on top of a movable piece in the sleeve. When one discharges his urine and stands up, the rear part of seat of closet stool will rebound promptly by the spring; meanwhile, the timing unit begins to count time, then, the driving arm makes the control arm release the movable piece in the sleeve by means of the pulling of timing unit and move upwards by the elasticity of spring. A rubber ring compresses air in the sleeve, the high velocity air will instantly rush in air container through a hole passage, pipe joint, filter and pipe. The air will open a movable lid for the purpose of water-flushing. In addition, on one side of inside closet stool, there is a small water-saving container; a floating piece can open the block-opening by means of pulling of a pull rod for the purpose of water-flushing small amounts of water to save water.

6 Claims, 8 Drawing Figures

MULTI-FUNCTION CLOSET STOOL

BRIEF SUMMARY OF THE INVENTION

This invention is a kind of new closet stool (or toilet fixture) with multi-functions. The special feature of this invention is that as soon as one sits on the seat of the closet stool, some components of this invention will be driven by the weight of a person; the timing unit will be driven and the inner part of piston filled with air by the steel cable actuating the piston and timing unit. As soon as one leaves from the seat of the closet stool and stands up, the timing unit will actuate the spring assembly of the piston after a few seconds to cause the air inside the sleeve jetting out with high velocity through an air pipe; the air jetting out will expand the air container, which will trigger a movable lid to release the water for flushing purpose automatically. In addition, a pressure gauge of this invention will indicate the inner pressure of this invention and reflect the trouble condition of the components. Another feature of this invention is that a pull rod is installed outside and at one side of the stool; after discharging urine, one can pull it up and release the water through a inside by-pass source to flush the urine; the device is for the purpose of saving water. This invention is a device which can really serve the purposes of automatic timing, flushing, and saving water.

BRIEF DESCRIPTIONS OF THE DRAWINGS

Figure 4A:
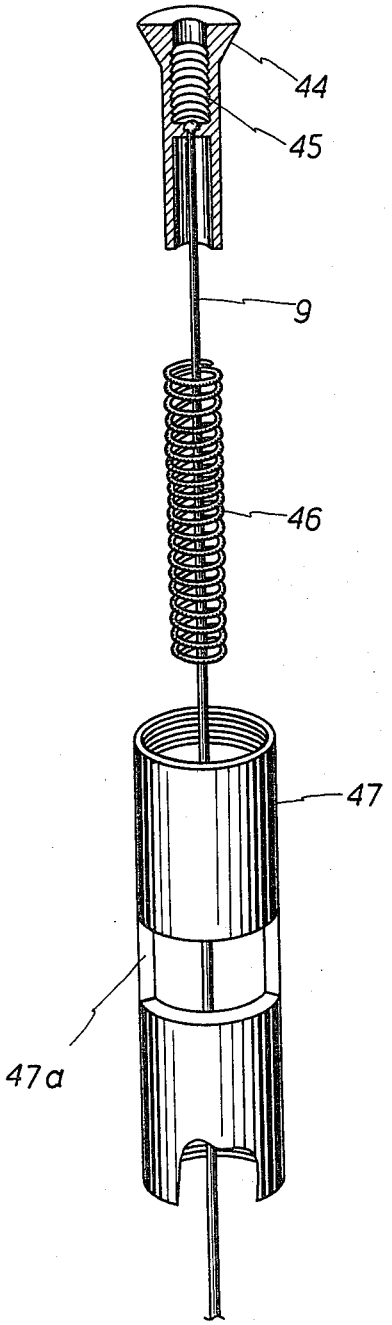
FIG. 4 is an exploded view of the piston used in the stool of the invention.
Figure 4B:
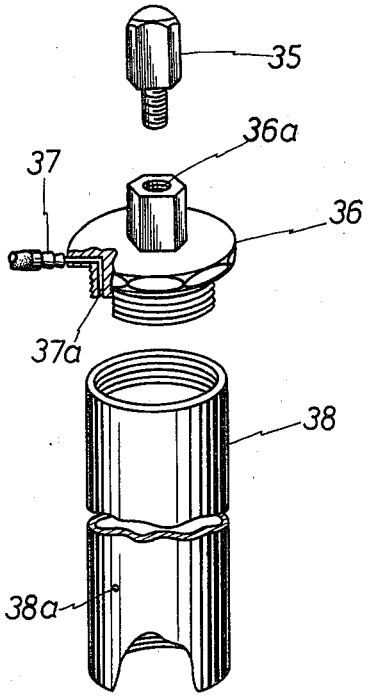

FIG. 4*b* shows an exploded view of the sleeve of the spring assembly of FIG. 4*a*.

Figure 4C:
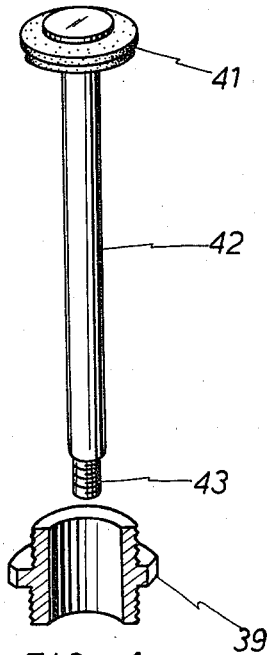

FIG. 4*c* shows an exploded view of the drive rod of the FIG. 4*a* assembly.

Figure 5:
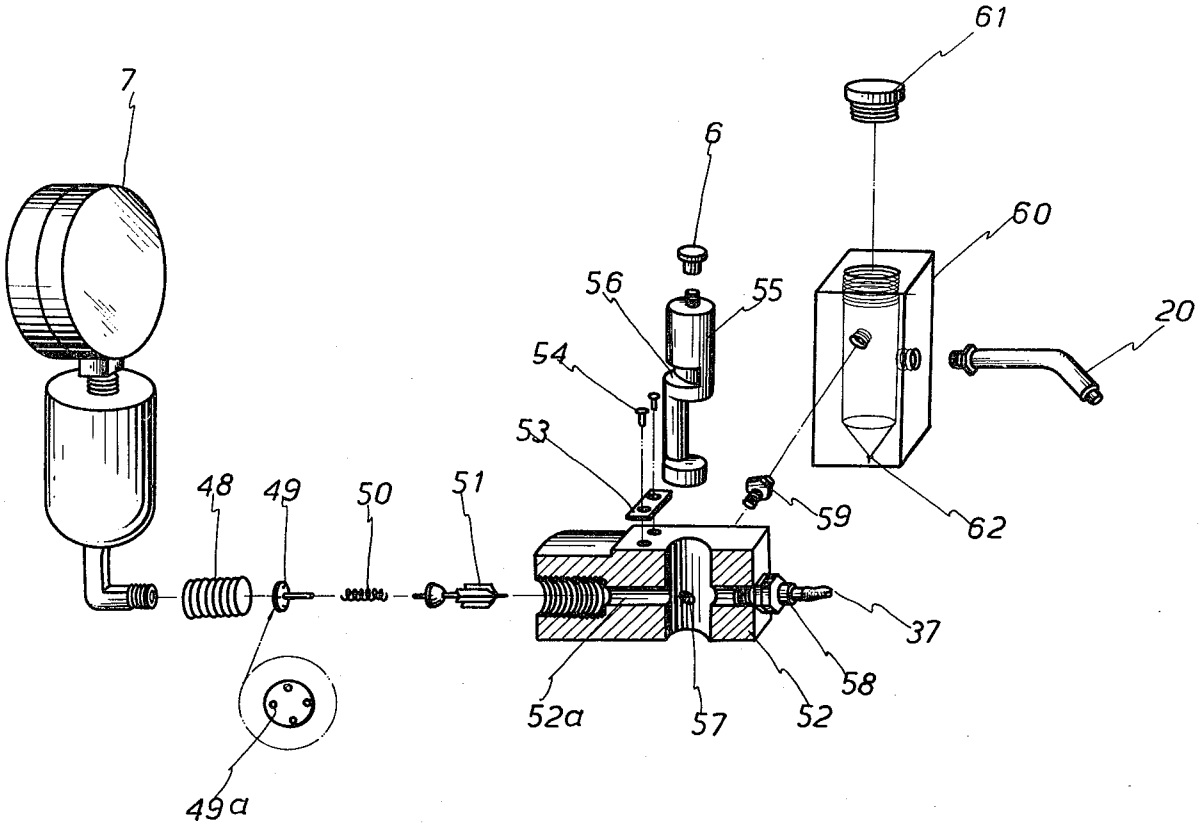
Figure 6:
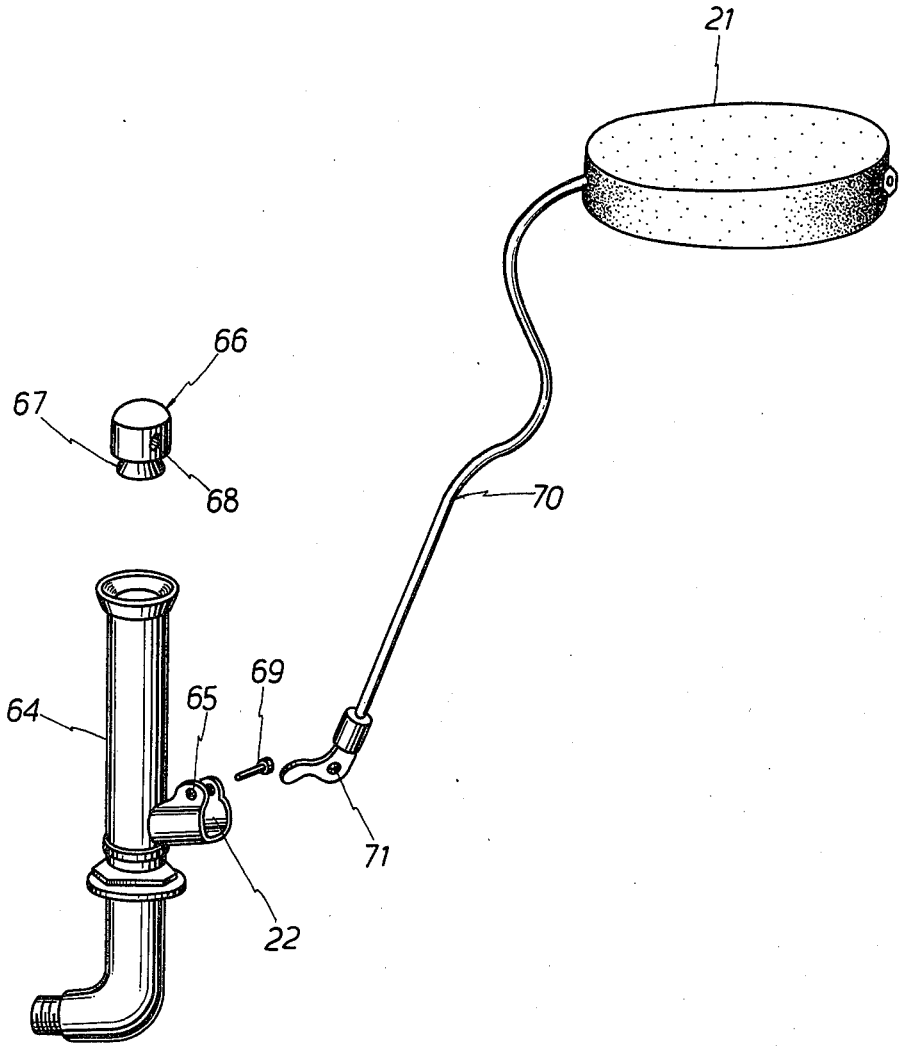

FIG. 5 is a disassembled view of the pressure gauge of this invention;

FIG. 6 is a disassembled view of the apparatus for the control of the water intake of this invention.

DETAILED DESCRIPTION OF THE INVENTION

Figure 1:
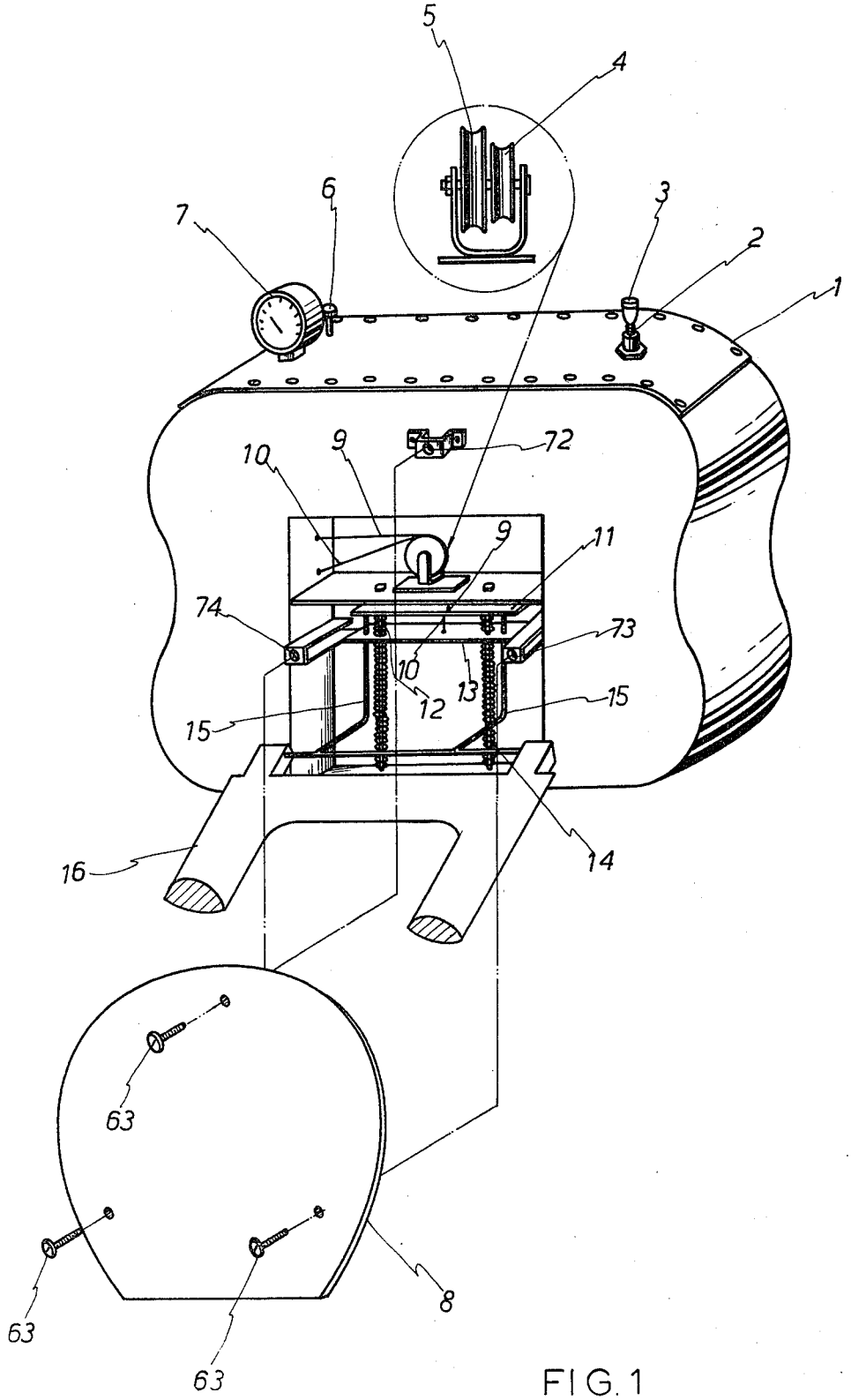
FIG. 1 is a perspective view of the invention.

This invention is a new model closet stool (or toilet fixture) having multi-functions, which is illustrated in detail by the enclosed figures and description as follows:

The perspective view of this invention as shown in FIG. 1 consists of water tank of closet stool 1, spring 2, pull rod 3, pulleys 4 and 5, control rod 6, pressure gauge 7, lid 8, seat of closet stool 16; wherein the seat of close stool 16 is supported by driving rod 15 to rise up to be sloping, the lid #8 is attached by three screws 63 to holes 72, 73 and 74 of water tank of closet stool 1.

Figure 2:
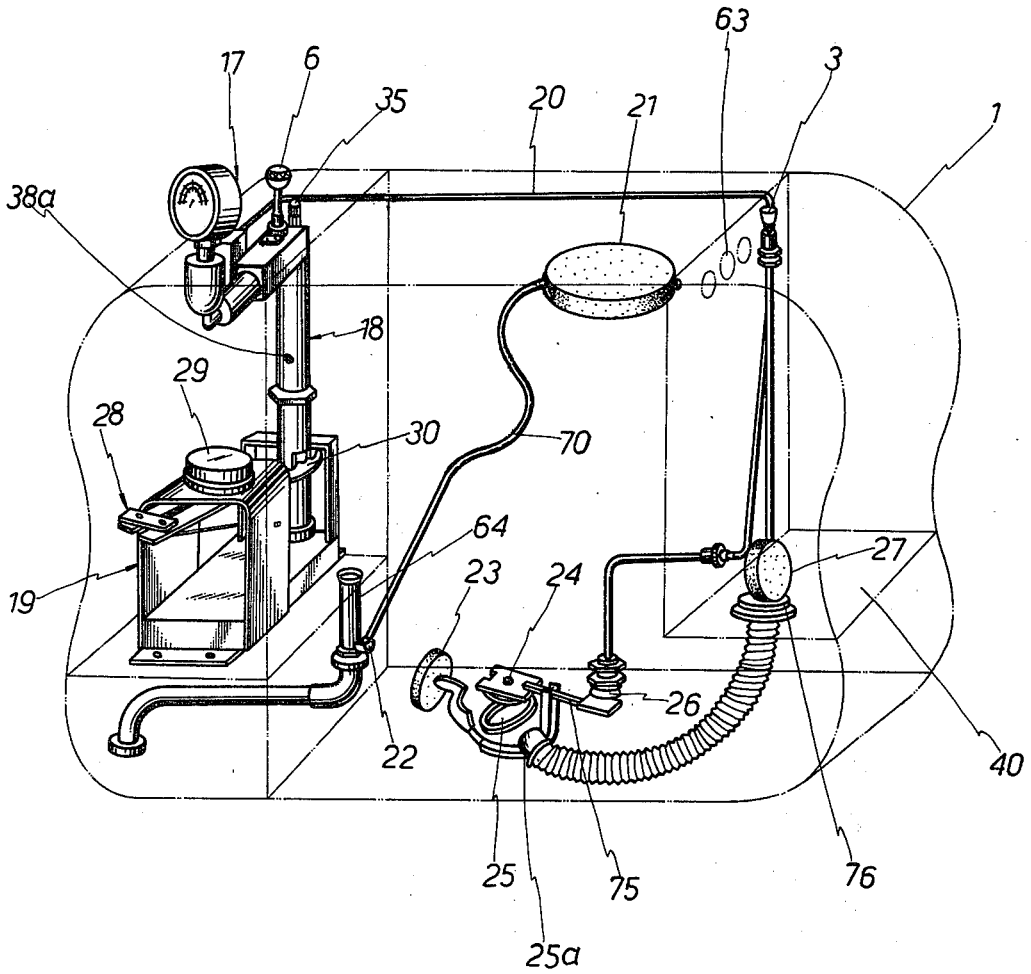
FIG. 2 is a perspective view of the inner construction of this invention.

The inside structure of the invention, as shown in FIG. 2, consists of piston assembly 18, pressure gauge 17, timing assembly 19, and pull rod 3. The middle part consists of water intake 22, and floating piece 21. The bottom consists of moving lid 24 and air container 26. Part of water outlet 25 consists of a floating ball 23, movable lid 24, lever 75 and air container 26. The water outlet is a sloping device which can enforce the power while flushing water. The sloping angle of this device was determined by testing of the applicant. The one side of lever 75 is connected to air container 26, the other side of it is movable lid 24. When air container 26 receives air with high velocity from piston assembly 18 thru air pipe 20, it expands to press down the one side of lever 75 to make movable lid 24 automatically open to release water for flushing purposes.

Figure 3:
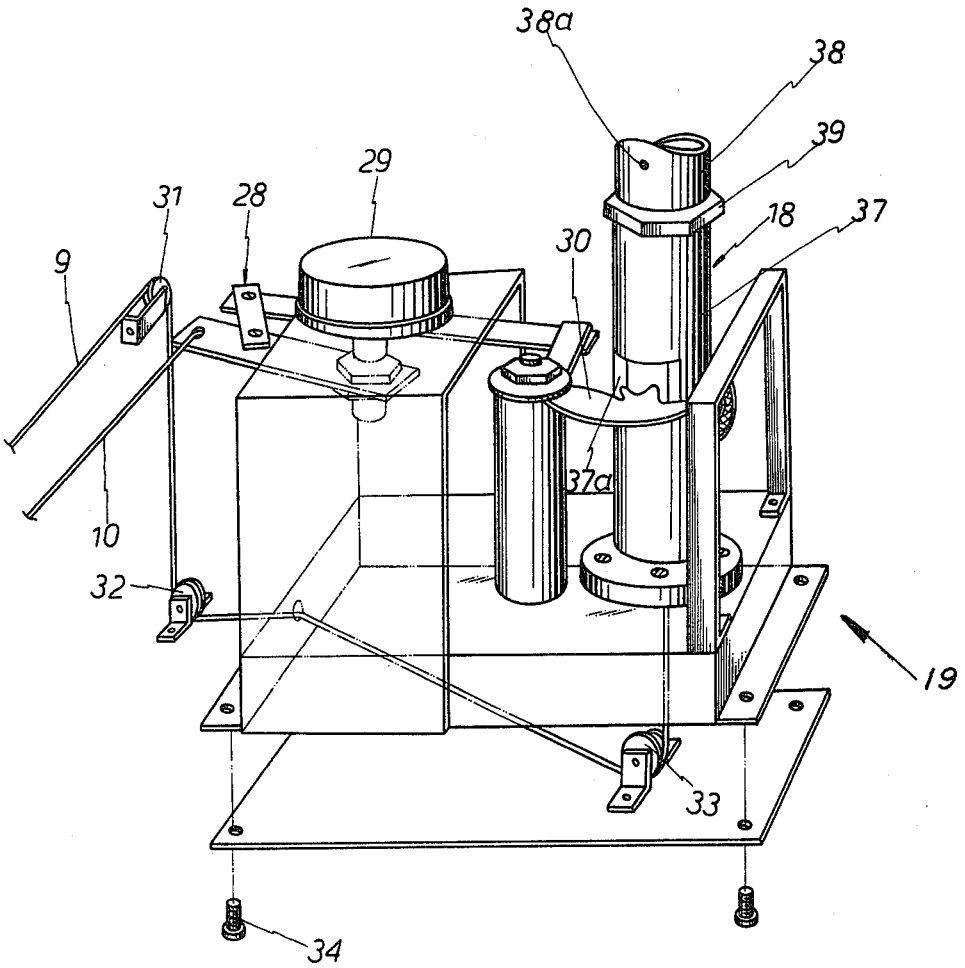
FIG. 3 is a perspective view of the structure of timing unit of the invention.

FIG. 3 shows the structure of timing assembly 19 in which the timing assembly 19 is set on the water tank of closet stool by bolts 34. The timing unit 29 is controlled directly by driving arm 28; i.e. when one sits on the seat of the closet stool, the driving steel cables 9 and 10 are pulled by the external force and cables will drive the driving arm 28, which in turn will cause the timing unit 29 to count time. Timing assembly 19 is connected to piston assembly 18 by control arm 30 being sandwiched on the opening 47*a* of sleeve 47 (shown in FIG. 4*a*).

The structure of piston assembly 18 is shown in FIG. 4*a;* wherein the top screw 35 is fixed right on the hole 36*a* of lid 36 in FIG. 4*a;* thru hole 36*a*, the lubricant oil is to be filled. The air hole 38*a* on sleeve 38 will take in air as the piston is being pulled down so as to let the sleeve 38 to be filled with air. A rubber ring 41 (FIG. 4*c*) and screw threads 43 are fitted respectively on the two ends of driving rod 42; the rubber ring 41 is acting as a piston. The driving rod 42 is fixed on the threads 45 of movable piece 44 by screw threads 43 (see FIG. 4*c*). One end of driving steel cable 9 is tied to the driving piece 11 (shown in FIG. 1) and the other end is tied to the said movable piece 44. When the driving piece 11 pulls the driving steel cable 9 by external force, it simultaneously moves movable piece 44 and driving rod 42 down, while the rubber ring 41 on the top of driving rod 42 slips down to the top of sleeve joint 39. When the external force diminishes, the movable piece 44, driving rod 42, and rubber ring 41 will rebound promptly from expansion of pressed spring 46 causing compression in sleeve 38. Sleeve 47 is connected with the sleeve 38 by sleeve joint 39.

The structure of pressure gauge assembly 17 is shown in FIG. 5. Pressure gauge 7 is fixedly attached on one end of filter 52 with thread sleeve 48, in which the filter piece 49, spring 50, and movable piece 51 are fitted. Filter piece 49 has several small holes 49*a*, filter piece 49 is pushed to one end of movable piece 51 by spring 50. Normally, the hole passage 52*a* is closely sealed by movable piece 51; while pressure gauge 7 measures air pressure. High velocity air enters gauge 7 from pipe joint 37 on the top of piston assembly 18 thru pipe 58 and hole passage 52*a*. The movable piece 51 and filter piece 49 will clean the air of oil, moisture, or other impurities to increase the life of pressure gauge 7. The said filter 52 is fitted on filter 60 with fixing screw 59. The function of filter 60, consisting of outlet 62 and lid 61, is not only to clean the filtered impurities but clear out the high velocity air from piston assembly 18 in order to balance the air pressure inside this invention. The high velocity air is cleared into air container thru air pipe 20.

The structure of the water intake control assembly of this invention is shown in FIG. 6. One end of control rod 70 is fitted with floating piece 21, which may be made of polythene to produce buoyancy. The other end of control rod 70 is fitted into the pipe 64, with bolt 69 passed thru holes 65 and 71 and inserted into the hole 68 on movable piece 66. At the bottom of movable piece 66 there is rubber piece 67. The moving up and down of movable piece 66 is controlled by the moving of floating piece of control rod 70, and purposes of controls the opening and closing of water intake 22.

The stool seat 16 of this invention is normally inclined on its rear end as shown in FIG. 1. Upon being seated on by a person, the stool seat 16 will descend as a result of a person's weight. The stool seat 16 will then actuate the driving rod 15, driving piece 11 and 13 pulling driving steel cable 9 fixed on driving piece 11 and cable 10 fixed on driving piece 13. The driving rod 42 and movable piece 44 in the piston assembly 18 will also be moved down by driving steel cable 9 thru pulley 31, 32, and 33. When rubber ring 41 passes the air hole 38*a*, the air will start to be taken into sleeve 38 and simultaneously, timing unit 29 will be actuated by driving steel cable 10 pulling driving arm 28, and the control arm 30 will also catch the upper end of movable piece 44. The piston assembly 18 and timing assembly 19 are all in a still state for the time being. As soon as the person stands up from the stool seat, the rear end of stool seat 16 will be promptly rised up as a result of the elasticity of spring 12 and 14 (FIG. 1) actuating the timing unit (the unit actuated for about 10 seconds), the driving arm 28 driven aside by timing unit 29. When the time controlled by timing unit has elapsed, the control arm 30 will release movable piece 44 and the driving rod 42 will be pushed upwards by means of the elasticity of spring 46 causing the air inside the piston assembly 18 instantly enter the air container 26 thru hole passage 37*a* and air pipe 58 and 20. The air container 26 will expand immediately and actuate the lever 75 which is connected with movable lid 24, opening movable lid 24 causing the water in the tank to flow out thru water outlet 25 for the purpose of flushing the urine.

In addition, along one side of water tank 1, a pull rod 3 has been fitted for the purpose of saving water. For instance, after discharging urine, one can just pull the rod 3 up to make floating piece 27 depart from the block-opening 76 causing the water in a small water-saving container by-pass water source 40 to be released and flow out from outlet 25 to flush the urine. Water enters into the small water-saving container thru small hole 63 of wall of water tank.

The control rod 6 controls the function of pressure gauge 7. It means that the control rod 6 can change the direction of driving rod 55, which can control the open and close of hole passage 52*a*. For instance, when the driving rod rotates to one direction which can open the hole passage, the air will enter in the pressure gauge 7 thru pipe joint 37, pipe 58 and holes passage 52*a*, and the gauge 7 will show the pressure inside the closet stool, wherein the normal pressure range is usually from 0.5–0.6 Psi. The driving rod is fixed by means of fixing piece 53 sandwiched in the groove 56 of the driving rod (shown in FIG. 5) and the fixing piece 53 is fixed by screw 54.

I claim:

1. A closet stool comprising: a water tank having a water outlet valve; spring biased seat, biased upwardly having levers connected to a plurality of cables; first cable connected to and actuating a timing assembly connected to a pressure gauge of a piston sleeve containing air; a second cable connected to an end of said piston sleeve, said sleeve and piston compressing air communicating with an expandable air container, said piston resiliently swing biased in an upward position, said air container connected to a pivotal lever on one end and the other end comprising a lid for said water outlet valve which is actuated by said air container, wherein said seat is depressed by an occupant which moves said first cable to actuate said timing assembly, when said seat is released said first cable again actuates said timing assembly wherein after a set period of time said timing assembly releases the air in said sleeve to an air outlet connected to said air container, expanding said air container to move said lever to open said lid on said valve to release the water in the water tank which flushes the closet stool, wherein said pressure gauge measures the air pressure in the system.

2. The closet stool of claim 1 wherein said pressure guage measures the air pressure in the system and is connected by a three-way valve to a plurality of filter means to filter impurities from said air.

3. The timing assembly as claimed in claim 1 consisting of a timing unit connected to a plurality of driving arms actuated by said first cable wherein one driving arm is connected to a control arm which moves the piston in said sleeve to compress the air in said sleeve.

4. The closet stool of claim 1 wherein the air outlet is open and the piston moves in the sleeve by the expansion of the spring surrounding the piston shaft to compress air which is passed to an air outlet to an air container causing the air container to expand which in turn opens the water outlet valve to flush the toilet.

5. The close stool of claim 2 wherein there is a secondary water tank connected to the toilet by a water bypass valve used to provide limited flushing of said toilet.

6. The closet stool as claimed in claim 1 comprising a pipe, control rod, movable piece and floating piece, wherein the control rod can actuate the moving up and down of said movable piece by means of floating piece to control the open and close of water intaking.

* * * * *